United States Patent [19]

Howell, Jr.

[11] 3,952,272

[45] Apr. 20, 1976

[54] SOLENOID CORE CONSTRUCTION

[76] Inventor: Alleyne C. Howell, Jr., c/o Howell Corp., 1180 Stratford Road, Stratford, Conn. 06497

[22] Filed: Feb. 12, 1975

[21] Appl. No.: 549,247

[52] U.S. Cl. ..... 335/264; 335/279

[51] Int. Cl.[2] ..... H01F 7/08

[58] Field of Search ..... 335/259, 264, 265, 267, 335/279, 296

[56] References Cited

UNITED STATES PATENTS

| | | | |
|---|---|---|---|
| 343,227 | 6/1886 | Cutten | 335/261 |
| 2,881,367 | 4/1959 | Watson | 335/264 X |
| 3,376,528 | 4/1968 | Macy | 335/296 |
| 3,621,422 | 11/1971 | Macy | 335/264 |

*Primary Examiner*—G. Harris
*Attorney, Agent, or Firm*—H. Gibner Lehmann; K. Gibner Lehmann

[57] ABSTRACT

A magnetic core construction for solenoids or electromagnets, comprising a plurality of unique magnetic laminations adapted to be stacked one on another into a pile. The laminations have interlocking means whereby, when stacked in a certain manner, the pile formed thereby constitutes a loose assemblage which cannot readily be dismantled. Also, such assemblage has the important feature that the adjoining laminations can all be spaced from each other a predetermined extent or else completely and tightly brought together into a compact mass. Means are provided for connecting a drive or linkage member to an end lamination whereby the forces involved in bringing together the laminations can be harnessed to produce useful output or work which is characterized by a more gradual build-up of the output force. The compacting of the assemblage is effected by the application of magnetic flux thereto, as by energizing a magnet coil of insulated wire, operatively associated with the laminations. The latter can all be identical to each other, in the form of metal stampings.

13 Claims, 14 Drawing Figures

SOLENOID CORE CONSTRUCTION

BACKGROUND

This invention relates to solenoids, and more particularly to the magnetic core constructions thereof. A characteristic of solenoids and magnets, which is often undesirable, is the unequal distribution of force over the working stroke, that is, the lack of a great force at the beginning of the working stroke, and the presence of excessive force at the end of the stroke. This is particularly noticeable where the stroke or movement of the core assemblage is relatively large. In the past various devices have been proposed and produced to improve this condition. Solenoids have been provided with dash-pots, clockworks and similar mechanical devices to smooth out the forces of the working stroke. In another direction, the core structures themselves have been altered and modified to level off the attractive force. A patent showing one such modified core structure is that issued to Werner, U.S. Pat. No. 1,699,866. Here the core laminations are joined by loose-fitting studs in the form of short, flat head screws which permit adjoining laminations to be either spaced apart of else contiguous with each other. While such an arrangement was operative for the desired purpose, it had drawbacks in that the screw threads required the laminations to be relatively thick, making for excessive eddy currents if alternating current is used for energizing the coil. Also, the stud or screw construction made for a costly product, considering component cost and assembly time.

SUMMARY

The above disadvantages and drawbacks of prior modified-core type solenoids are obviated by the present invention, which has for one object the provision of an improved distributed-force type magnet or solenoid core wherein the cost is greatly reduced, and essentially brought down to a practical figure that is commercially feasible. A further object of the invention is to provide an improved magnetic device as above set forth, which has reduced eddy currents whereby its use is not restricted to d.c. energization.

A feature of the invention is the provision of a distributed-force type core wherein the laminations are identical metal stampings which can be readily hand-assembled and locked to each other against inadvertent dismantling.

The above objects are accomplished by stamping out a plurality of identical metal core plates to have integral assembly hooks adapted to pass through apertures of adjoining identical core plates. The plates additionally have clearance apertures to accommodate the tip portions of the assembly hooks. A drive or linkage rod passes through all the plates and locks the same against edgewise movement whereby no unhooking can occur after the initial assembly thereof. The plates are normally held slightly separated by a coil spring carried by the linkage rod, and can be compacted into a contiguous assemblage when influenced by magnetic flux. The compacting relative movement between the plates effects a distribution of the force delivered by the rod, over its working stroke. The provision of identical metal stampings formed to be self-holding by means of integral hooks, results in a low fabrication cost, and makes possible thin plates with low eddy currents.

Other features and advantages will hereinafter appear.

In the accompanying drawings, illustrating one embodiment of the invention:

Figure 1:
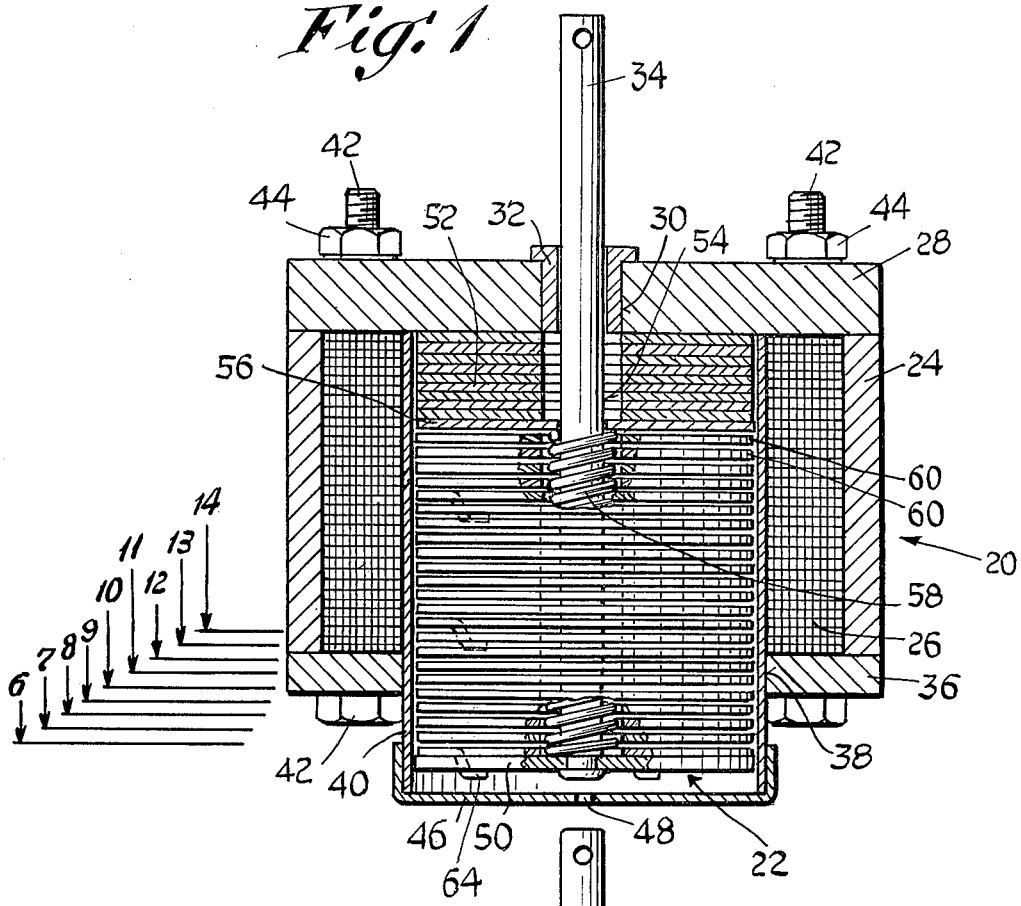
FIG. 1 is an axial sectional view of a solenoid incorporating the improved core construction of the invention, shown in the loose or non-compacted condition.
Figure 2:
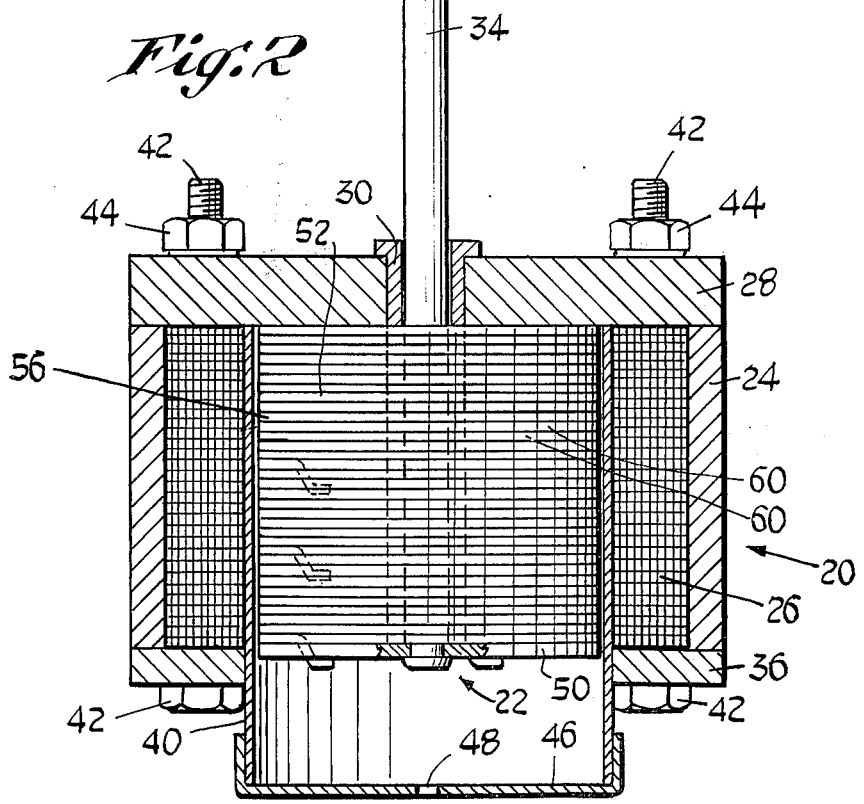
FIG. 2 is a view like that of FIG. 1 but showing the core construction in the compacted condition, at the end of the stroke.
Figure 3:
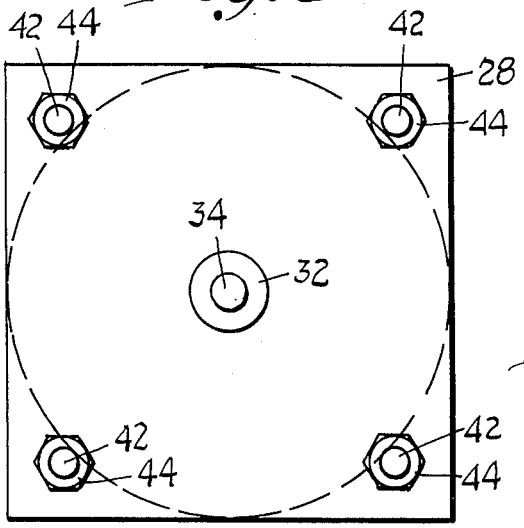
FIG. 3 is a top plan view of the solenoid.
Figure 4:
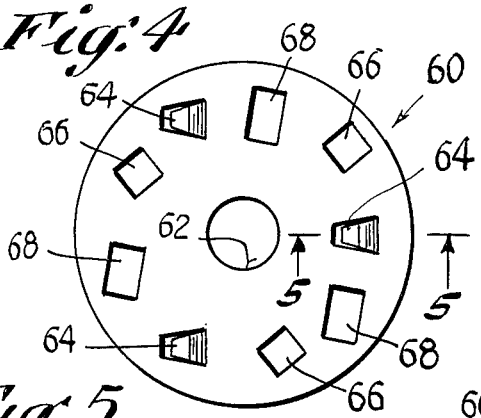
FIG. 4 is a top plan view of one of the interlocking stamped sheet metal laminations as provided by the invention.

Referring first to FIGS. 1–3, the solenoid illustrated therein comprises a stationary magnet or coil structure designated generally by the numeral 20, and a movable core structure designated generally by the numeral 22. The structure 20 has an outer magnetic shell in the form of a flux-carrying cylindrical casing 24 which encloses a magnet coil 26. At one end, the casing 24 has attached to it a magnetic end plate 28 that has a central aperture 30 provided with a bearing bushing 32 through which there extends a plunger rod or linkage member 34. The member 34 is connected to a novel movable magnetic core structure to be driven thereby, as will be hereinafter brought out in detail.

At its other end, the casing 24 has affixed to it a second magnetic end plate 36 differing from the end plate 28 in that it has a larger central aperture 38 in which there is received a cylindrical bobbin 40 of insulating or non-magnetic material, around which the magnet coil 26 is wound. The bobbin 40 closely fits in the aperture 38 of the end plate 36, and extends through the casing 24 in concentric relation thereto, terminating at the upper end plate 28. As seen in FIG. 3, the end plates 28 and 36 are preferably of square configuration, and are clamped together against the opposite ends of the cylindrical casing 24 by draft screws 42 having nuts 44.

It will be understood that the magnet coil 26 is suitably insulated from the core structures 24, 28, 36 as well as from the bobbin member 40 (in the event that the latter is made of non-magnetic metal). A suitable means (not shown) can be provided for bringing out the leads from the coil 26 in order to effect energization of the same, as will be understood. An end cap 46 can be press-fitted on the exterior end of the bobbin member 40, such cap having a vent opening 48 to avoid airtight sealing of the interior space of the bobbin, if this should be desired.

In the circumstance where the bobbin 40 is made of metal, it can also serve as a bearing for the plunger assemblage, and this bearing function is also possible if the bobbin is constituted of plastic substance having desirable friction qualities, such as nylon plastic.

In conjunction with the bearing bushing 32 for the plunger rod 34 a second bearing is provided in the bobbin 40, and this may be advantageously constituted of a circular metal end plate 50 which is secured to the inner end of the rod 34 in any suitable way, as by heading over the rod in the manner shown in FIGS. 1 and 2.

In accordance with the present invention, in conjunction with the above-described solenoid or magnet construction there is provided within the bobbin 40 a novel and improved, movable core and cooperable stationary core structure so constituted as to smooth out the pushing forces imparted to the plunger rod 34 when the magnet coil 26 is energized. Considering first FIG. 1, there is disposed in the upper portion of the space enclosed by the bobbin 40 and contiguous to the upper end plate 28 a stationary magnet core assemblage comprising a plurality of stamped sheet-metal laminations designated generally by the numeral 52. The laminations 52 can be in the form of circular discs closely fitting in the bobbin 40 and having aligned central apertures 54 through which the plunger rod 34 extends with appreciable clearance. A lowermost stationary lamination 56 has a central aperture which closely slidably fits the plunger rod 34 whereby it can constitute an abutment for one end of a helical compression spring 58 carried by the rod.

The other or lower end of the compression spring 58 engages the bearing plate 50 of the movable core assemblage as seen in FIG. 1. By such construction the spring 58 normally tends to maintain the plates or laminations 50, 56 in widely separated dispositions, as illustrated in FIG. 1, thereby biasing the plunger rod 34 to its retracted position shown in this figure.

Between the lamination plates 50, 56 the invention provides a loose stack of unique, identical interlocking core pieces 60, each core piece comprising a metal stamping of magnetic material. The core laminations or plates 60 are shown as having circular configurations whereby they are adapted to be aligned along a central axis which can be represented by the plunger rod 34. For this purpose, the core plates 60 have central apertures 62 through which the plunger 34 and spring 58 extend, as seen in FIG. 1. Each core plate 60 has a plurality of hooks 64 on one side, disposed about the axis or central aperture 62 thereof. Also, each core plate has hooking apertures 66 disposed about the central aperture 62 and adapted to receive the hooks 64 of an adjoining, similar core plate when both plates are superposed one on the other. Additionally, each core plate 60 has clearance apertures 68 disposed about its axis and adapted to receive portions of the hooks 64 of a third and similar core plate which has been attached by said hooks to the second-mentioned core plate.

Figure 5:
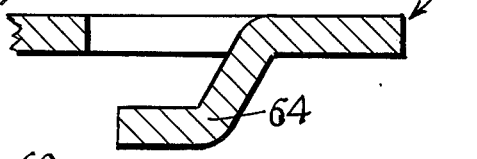
FIG. 5 is a fragmentary section taken on the line 5—5 of FIG. 4.
Figure 6:
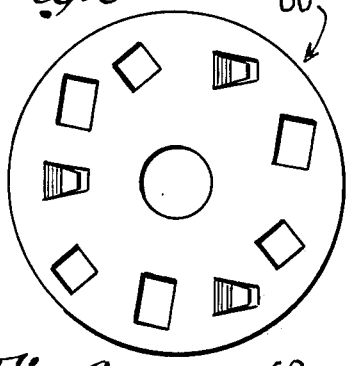
FIG. 6 is a top plan view of the lowermost one of the interlocking laminations of the stack of FIG. 1, as indicated by the direction line "6" shown in FIG. 1.
Figure 7:
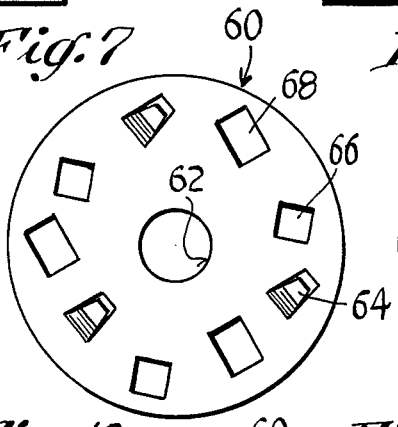
FIG. 7 is a top plan view of the next higher interlocking lamination, as indicated by the direction line "7" shown in FIG. 1.
Figure 8:
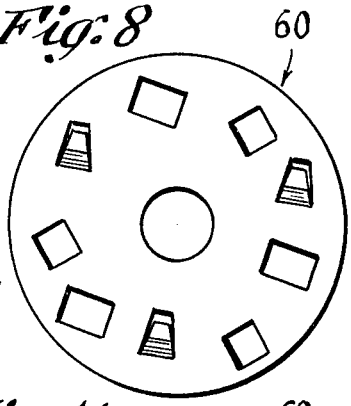
FIG. 8 is a top plan view of the third from bottom interlocking lamination, as indicated by the direction line "8" shown in FIG. 1.
Figure 9:
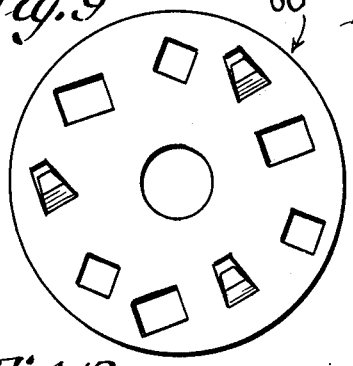
FIG. 9 is a top plan view of the fourth from bottom interlocking lamination, as indicated by the direction line "9" shown in FIG. 1.
Figure 10:
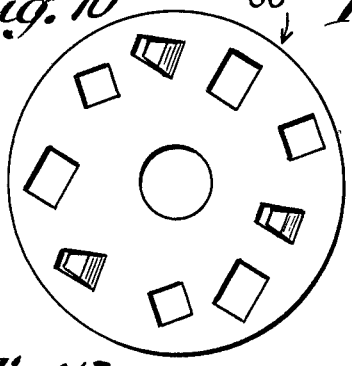
FIG. 10 is a top plan view of the fifth from bottom interlocking lamination, as indicated by the direction line "10" shown in FIG. 1.
Figure 11:
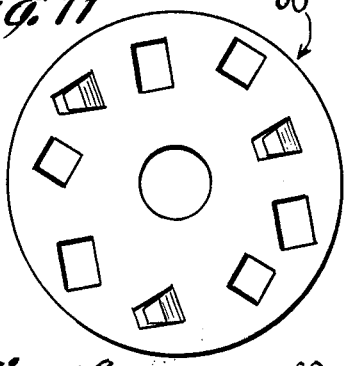
FIG. 11 is a top plan view of the sixth from bottom interlocking lamination, as indicated by the direction line "11" shown in FIG. 1.
Figure 12:
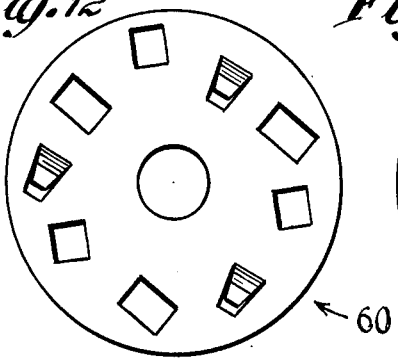
FIG. 12 is a top plan view of the seventh from bottom interlocking lamination, as indicated by the direction line "12" shown in FIG. 1.
Figure 13:
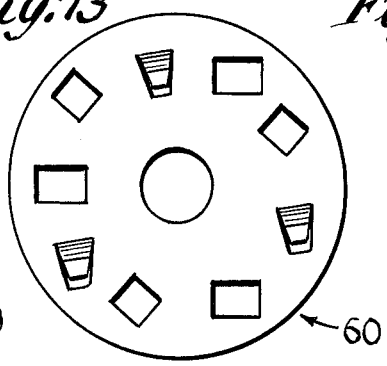
FIG. 13 is a top plan view of the eighth from bottom interlocking lamination, as indicated by the direction line "13" shown in FIG. 1.
Figure 14:
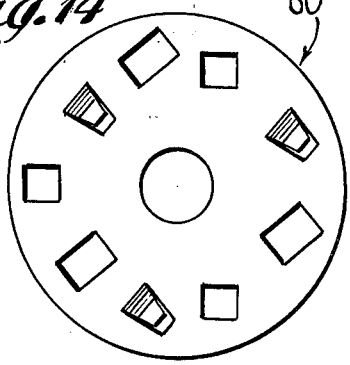
FIG. 14 is a top plan view of the ninth from bottom interlocking lamination, as indicated by the direction line "14" shown in FIG. 1.

Referring to FIGS. 1 and 5 it will be seen that the hooks 64 of the core plates project from the sides of the plates a distance which is greater than twice the thickness of the core plates. Accordingly, when a hook 64 is received in a hooking aperture 66 of an adjoining plate, a portion of the hook will project beyond the outer face of the second plate a slight amount, and such portion is then accommodated mostly in a clearance aperture 68 of a third plate (assuming that the first two plates when hooked together are in contiguous relation) and to a lesser extent in one of the openings of a fourth plate formed by a hook thereof. It will be seen from FIG. 1 that 23 of the core plates 60 have been assembled to each other by hooking one plate to the next, and so on. In effecting this, each plate that is hooked or added to a preceding plate must first be oriented with respect to the preceding plate, in a manner such that it is disposed an angle of 40° from a theoretical starting position wherein the configurations of the two plates are all in alignment with each other. Thus, each succeeding plate 60 will have a rotative position 40° removed or turned from the preceding plate, and this arrangement is illustrated in FIGS. 6 through 14, wherein plan views are illustrated of the lowermost nine core plates 60 of the movable core assemblage.

Considering FIG. 1, the assembly of the core plates 60 must be effected starting with the lowermost core plate and proceeding upward as each succeeding core plate is applied to the stack. In applying each core plate, the hooks 64 thereof are placed in the hooking apertures 66 of the preceding core plate. For such placement, the core plate being applied is disposed in a position slightly shifted edgewise with respect to the preceding plate. After the hooks have been received in the hooking apertures, then the plate being added to the stack is shifted edgewise a slight amount to bring the central aperture 62 thereof in registration with all of the other central apertures 62 of the preceding core plates. With the configuration of core plate illustrated herein, it is not possible to assemble a stack of core plates if one should attempt to start with the uppermost plate and add plates below this, one at a time. Preferably, as illustrated herein, each core plate 60 has a total of three hooks 64, a total of three hooking apertures 66, and a total of three clearance apertures 68 all disposed in a circle about the central aperture of the plate, with the locations and sizes as illustrated in the drawings. With such arrangement, each core plate 60 can be identical to all of the other core plates whereby stamping and fabrication of the core assemblage is greatly simplified since but a single tool set-up is required to form the core plates.

Referring again to FIG. 1, the lowermost bearing plate 50 does not have hooks but instead only has three hooking apertures 66 to receive the hooks 64 of the adjoining core plate 60.

The above core plate construction provides a unique advantage, in that the plates when assembled can be loosely stacked in spaced relation, as illustrated in FIG. 1 whereby appreciable air space exists between the adjoining core plates. Or, the core plates can all be stacked in a tight, compact arrangement as illustrated in FIG. 2, wherein no space whatsoever exists between the adjoining core plates. Accordingly, by virtue of the variable spacing between the core plates there is had a smoothing-out action of the forces applied to the plunger rod 34 at the time that the magnet coil 26 is energized. Since the interior space of the bobbin 40 is largely occupied with core iron comprising the core plates 60 even for the retracted condition of the plunger 34 shown in FIG. 1, there will be an appreciable force applied to the plunger when the coil 26 is first energized. This is in contrast to conventional solenoid structures wherein a very large air gap exists between the movable armature or core structure at the time that the armature is retracted and the coil experiences its initial energization.

It will be seen from FIG. 2 that as the plunger rod 34 reaches the termination of its stroke, the movable core iron will have become compacted and tightly stacked whereby the force on the plunger at the completion will be virtually the same as that experienced by a conventional solenoid at the time that the large initial air gap thereof is reduced or eliminated. It can be readily understood that even though the loosely stacked core pieces 60 are surrounded by air spaces or air gaps, the fact that these core pieces are disposed more completely in the concentrated magnetic field produced by the coil 26 will cause a stronger initial push which can be supplied by the plunger rod 34. Thereafter, upon deenergization of the coil 26, the compression coil spring 58 will expand, returning the loosely stacked core pieces to the starting position illustrated in FIG. 1.

While the present invention is illustrated in conjunction with core pieces 60 which are of circular configuration, it will be understood that other shapes are possible such as hexagonal, octagonal, square, etc. to suit various requirements.

It will now be seen that by the present invention I have provided a unique, movable core structure for magnets, solenoids and the like which is constituted mostly of identical metal stampings of magnet material whereby there is minimized the initial tooling expense in fabricating the core. The stampings can be easily and quickly hand assembled, and have the characteristic of being capable of either a loose or else a tight stacking, thereby to smooth out the mechanical forces generated by the energized magnet coil. Once the loose core pieces 60 are assembled to each other and placed on the plunger 34, the latter will prevent edgewise shifting of the core pieces whereby these cannot be disassembled. By virtue of the core pieces being constituted of relatively thin laminations the magnitude of eddy currents is greatly reduced, enabling the movable core structure to be used with other types of stationary cores which could be especially adapted for alternating current energization.

Variations and modifications are possible without departing from the spirt of the claims.

I claim:

1. A manually-stackable, hooking-type lamination constituting one of a plurality of similar, loose, stackable interlocking core pieces for a solenoid, comprising in combination:

a. a stamping in the form of a metal core plate of magnetic material, b. said core plate being adapted to have an axis which is substantially perpendicular to the plane thereof, c. a plurality of hooks on one side of the core plate, disposed about the axis thereof, d. said core plate having hooking apertures disposed about its axis and adapted to receive the hooks of an adjoining similar core plate when both plates are superposed one on the other, e. said core plate having clearance apertures disposed about its axis and adapted to receive portions of the hooks of a third and similar core plate which has been attached by said hooks to the second-mentioned core plate, f. said hooks of the first-mentioned core plate projecting from the side of the same a distance greater than twice the thickness of the core plate.

2. A lamination as in claim 1, wherein:

a. the core plate has a total of three hooks, b. all of said hooks facing in one direction.

3. A lamination as in claim 1, wherein:

a. the hooking apertures are substantially square in configuration.

4. A lamination as in claim 1, wherein:

a. the clearance apertures are substantially rectangular in configuration.

5. A lamination as in claim 1, wherein:

a. the hooks are integral with the plate and lanced therefrom.

6. A lamination as in claim 1, wherein:

a. the core plate has three hooks, three hooking apertures, and three clearance apertures, b. said hooks, hooking apertures and clearance apertures being disposed substantially in a circle close to the periphery of the plate.

7. A lamination as in claim 6, wherein:

a. the core plate is circular and has a central opening to admit a plunger rod.

8. A force-smoothing core assemblage stack for a solenoid comprising, in combination:

a. a plurality of loose, stacked interlocking core pieces secured together by hooks and movable with respect to one another between closely juxtaposed positions and spaced apart positions, b. each of said core pieces comprising a stamping in the form of a metal core plate of magnetic material, c. said core plate being adapted to have an axis which is substantially perpendicular to the plane thereof, d. a plurality of hooks on one side of the core plate, disposed about the axis thereof, e. said core plate having hooking apertures disposed about its axis and adapted to receive the hooks of an adjoining similar core plate when both plates are superposed one on the other, f. said core plate having clearance apertures disposed about its axis and adapted to receive portions of the hooks of a third and similar core plate which has been attached by said hooks to the second-mentioned core plate, g. said hooks of the first-mentioned core plate projecting from the side of the same a distance greater than twice the thickness of the core plate.

9. A core assemblage as in claim 8, wherein:

a. the core plates each have three hooks, b. consecutive core plates being disposed rotatively 40 degrees from each other.

10. A core assemblage as in claim 8, and further including:

a. a plunger rod, b. said core plates being circular and having aligned central openings, c. a compression coil spring carried on the plunger rod, d. said rod and spring extending through the aligned openings of the plates, e. an end plate secured to the plunger rod and disposed at one end of said stack of core plates, f. one end of the coil spring applying a biasing force to said end plate.

11. A core assemblage as in claim 10, and further including:

a. a plurality of closely piled circular core plates having aligned central openings, disposed at the other end of said stack of core plates, b. said plunger rod passing through said closely piled core plates.

12. A core assemblage as in claim 11, wherein:

a. the other end of the coil spring applies a biasing force to said closely piled core plates.

13. A solenoid comprising a core assemblage as in claim 8, and further including:

a. a magnet coil surrounding said stacked core pieces, and b. means providing a stationary return magnetic circuit for said core pieces, c. said means surrounding the magnet coil and having end members one of which encircles said stacked core pieces.

* * * * *